US007607423B1

(12) United States Patent
Kees et al.

(10) Patent No.: US 7,607,423 B1
(45) Date of Patent: Oct. 27, 2009

(54) DRAW HOLDING AND DRAW RELEASING MECHANISM

(76) Inventors: Galen D. Kees, 400 S. Second Ave., Apt. No. 5, Durand, WI (US) 54736; Roger A. Kees, 18300 54th Ave., Chippewa Falls, WI (US) 54729

( * ) Notice: Subject to any disclaimer, the term of this patent is extended or adjusted under 35 U.S.C. 154(b) by 0 days.

(21) Appl. No.: 12/291,955

(22) Filed: Nov. 17, 2008

(51) Int. Cl.
*F41B 5/18* (2006.01)

(52) U.S. Cl. ..... 124/35.2; 124/86

(58) Field of Classification Search ..... 124/23.1, 124/24.1, 25.6, 35.2, 44.5, 86, 88
See application file for complete search history.

(56) References Cited

U.S. PATENT DOCUMENTS

| | | | | |
|---|---|---|---|---|
| 1,210,332 | A | | 12/1916 | Kvistad |
| 2,664,078 | A | | 12/1953 | Irwin |
| 2,815,016 | A | | 12/1957 | Kellogg |
| 3,561,418 | A | * | 2/1971 | Fredrickson ..... 124/24.1 |
| 3,895,621 | A | | 7/1975 | Kellogg |
| 4,854,293 | A | | 8/1989 | Roberts |
| 5,000,154 | A | | 3/1991 | Slayton |
| 5,002,035 | A | | 3/1991 | Brooks |
| 5,065,730 | A | | 11/1991 | Kluver |
| 5,092,308 | A | | 3/1992 | Sheffield |
| 5,146,908 | A | | 9/1992 | Larson |
| 5,156,138 | A | | 10/1992 | Grover |
| 5,390,654 | A | | 2/1995 | Perkins |
| 5,465,705 | A | | 11/1995 | Baeseman |
| 5,598,830 | A | | 2/1997 | Creel, Sr. |
| 5,649,524 | A | | 7/1997 | Pullin |
| 5,944,004 | A | | 8/1999 | Goff et al. |
| 6,012,440 | A | | 1/2000 | Grindle |
| 6,161,532 | A | | 12/2000 | Goff et al. |
| 6,196,210 | B1 | | 3/2001 | Chamberlain |
| 6,213,113 | B1 | | 4/2001 | Groover et al. |
| 6,679,240 | B1 | | 1/2004 | Hurd |
| 6,968,836 | B1 | | 11/2005 | Kees |
| 7,299,795 | B2 | | 11/2007 | Brannen |

* cited by examiner

*Primary Examiner*—John Ricci
(74) *Attorney, Agent, or Firm*—Tipton L. Randall

(57) ABSTRACT

A draw holding and draw releasing mechanism assembly comprises a mounting bracket, with a passageway controlled by a levered cam, secured to a bow. A draw bar is movable and lockable within the passageway by the levered cam. The draw bar includes a hand grip and an adjacent linear slot with an adjacent cam member, having a cradle notch and finger grip. The cam member rotates from a bowstring accepting position, with the cradle notch open to the draw bar slot, to a bowstring retaining position, with the cradle notch intersecting the draw bar slot. Moving the draw bar within the passageway brings the bowstring into the linear slot and into the cam member's cradle notch. Grasping the finger grip rotates the cam member to retain the bowstring. Moving the bowstring to the desired draw and then actuating the levered cam temporarily locks the draw bar. Releasing the finger grip allows the cam member to rotate and release the retained bowstring, firing an arrow.

21 Claims, 10 Drawing Sheets

DRAW HOLDING AND DRAW RELEASING MECHANISM

CROSS-REFERENCE TO RELATED APPLICATIONS, IF ANY

Not applicable.

STATEMENT REGARDING FEDERALLY SPONSORED RESEARCH OR DEVELOPMENT

Not applicable.

REFERENCE TO A MICROFICHE APPENDIX, IF ANY

Not applicable.

BACKGROUND OF THE INVENTION

1. Field of the Invention

The present invention relates to a draw bar and draw holding device employed with a bow, such as a compound bow, that utilizes the principal of levers to the extent that the archer can hold the draw, employing only a fraction of the effort conventionally required.

2. Background Information

The sport of archery requires the archer to exert a relatively large force during bowstring pull back to draw the bow to a fully tensioned condition for firing an arrow. Compound bows incorporate cams and cables to reduce by 50 to 80 percent the force needed to hold the bow at full draw. However, with compound bows, the bowstring circumscribes eccentric wheels rotatably mounted on the ends of the bow's limbs, and a large force must be applied by the archer's arms during the initial stages of string pull back. Consequently, even after firing just a few shots, muscles fatigue and cramping in the archer's arms and shoulders are often experienced, which leads to inaccuracy and prevents the archer from performing extensive target practice.

Archers and bow hunters have used drawlocks of various types for many years, including the locking mechanisms on centuries-old crossbows. For upright bows, including compound bows, a drawlock has generally been either a fixed rod along which the bowstring is drawn or a moveable rod drawn along with the bowstring. Both types use some sort of latch mechanism to lock the bowstring at full draw and a release mechanism to release the bowstring and propel the arrow. The term "full-draw" is used to mean the aimed draw position for a bow properly matched to the archer, rather than an absolute maximum draw. However, in many states, locking the bowstring at full draw with the bowstring locked in a release mechanism requires the archer to have a cross-bow license in addition to an archery hunting license.

A large number of patents have been granted concerning devices for drawing and releasing a bowstring for an archery bow. In U.S. Pat. No. 1,210,332, Kvistad discloses a mechanical lever fastened between the hand grip portion of a bow and sliding upon the bowstring for drawing the bow into a fully extended position. The device includes a specialized trigger release and arrows.

Irwin, U.S. Pat. No. 2,664,078, describes a bowstring support, which includes a handle for drawing the bowstring and a nocked arrow into a fully drawn position. The bowstring support slides within a channel fastened to the front of the bow and has one or a series of notches so that as the bowstring and nocked arrow are drawn back with the bowstring support by pulling on the handle, the bowstring support falls into one or more of the notches, locking the bowstring in a properly drawn position. The arrow is gripped by a trigger notch within the bowstring support and a finger trigger is provided on the bowstring support for releasing the bowstring and the arrow. It should be noted that the support does not swing out of the way, but is merely mounted to one side of the bowstring and the arrow and remains in position during release.

In U.S. Pat. No. 2,815,016, Kellogg discloses an attachment for a long bow in the form of two fixed parallel rods attached to the hand grip of the bow and extending to a handle behind the position of the cocked bow. The handle includes a trigger and release mechanism for holding the cocked bow and arrow in position and then releasing the bow and arrow.

Fredrickson, in U.S. Pat. No. 3,561,418, describes an archery bow having telescoping members mounted thereon that extend rearwardly of the bow. On one of the telescoping members is a handhold member used to support a bowstring during the stressing thereof. On the outer member of the two telescoping members is a device that engages the inner telescoping member and holds the inner telescoping member in a rearwardly extended position against the stress of the bowstring. The telescoping members are controlled from the handhold member to release the device that holds the inner telescoping member in a rearwardly extended position.

In U.S. Pat. No. 3,895,621, Kellogg discloses an improved trigger release device for a longbow. A bracket is pivotally mounted on the bow handle and supports a pair of rods having sliding fits in a pair of guide sleeves, so that the rods are parallel with an arrow fitted to the bow on opposite sides of the arrow. A yoke connects the rods in front of the bow handle, and a trigger device connects the rods rearward of the bowstring. The yoke is latched to the bracket near the handle to hold the rods and the trigger device in a full-draw position for trigger release of the arrow. A latch holds the bracket to the handle in an operating position and allows the bracket, rods, and trigger device to be pivoted to the region of one of the bow limbs for easier storage of the device.

Roberts, in U.S. Pat. No. 4,854,293, describes a bowstring drawback and release device having a T-shaped handle member, with the stem of the T extending forward and connected by a ball and socket joinder to a support for a bowstring catch. The support is in the form of a housing that is open at its forward end and along its bottom. The catch is a lever within and pivoted to the housing intermediate its ends so as to drop open upon release, effected by pulling a resiliently biased trigger that is pivoted within the housing and extends outside for convenient pulling, as by the thumb of the hand of an archer holding the handle. An important feature is the provision of a transversely segmented, longitudinal, composite rod having a laterally confined, rigid, forward end segment that engages a rearwardly shouldered portion of the catch for holding the bowstring in engaged drawback position. A laterally unconfined, rearward end segment of stiffly flexible material is connected to the trigger for accommodating any misalignment of the handle member when the trigger is pulled.

In U.S. Pat. No. 5,000,154, Slayton discloses a bow draw support assembly in which a clevis, attached to a compound archery bow hand grip, supports an extended rod. At the rear end of the rod is a yoke with two notches for supporting a bowstring. An internal spring within the clevis biases the rod to an outward position, and a finger-acting lever attached to the rod, permits the rod to swing in line with the bowstring when the bow is drawn. The bowstring is supported by the notches in the rod. When it is desirable to use the bow, the string is slightly drawn and the internal spring causes the support assembly to swing out of the way of the bowstring, permitting the archer to aim and release.

Brooks, in U.S. Pat. No. 5,002,035, discloses a bow pressure relief string holder device for a compound archery bow in the form of a first fixed leg mounted above the hand grip portion of the bow, extending to the rear, and a second leg pivotally mounted to the first leg. The joint between the legs is spring-loaded so that the second leg supports the bowstring in a cocked position, but, when the bowstring is pulled back further, the second leg pivots away, out of the line of the bowstring.

In U.S. Pat. No. 5,065,730, Kluver discloses a bowstring prop for archery bows comprising an elongated, rigid member having an inner end adapted to frictionally engage the handle portion of the bow and an outer end adapted to engage the bowstring to hold the string in a drawn condition. The bow may be tensioned by use of the archer's foot and leg muscles with relatively little effort by the user. Once the bowstring is fully drawn, the bow prop is interposed and retained between the bow and the bowstring, retaining the bowstring under tension and the bow flexed. The bow is aimed and fired in the usual manner, and drawing the bowstring slightly further back allows the prop to fall to the ground, and the arrow is released in the normal manner.

Sheffield, in U.S. Pat. No. 5,092,308, describes an archery bow with a tubular sight with internal distance adjustment, a bowstring handle with a trigger-release and a hand anchor for holding the bowstring until released. An arrow-centering indentation with resilient centering means is provided at the opposite side of the bow from a bow handle, extended in a manner that the bow can be held horizontally like a crossbow for greater stability, convenience and ease of operation.

U.S. Pat. No. 5,146,908 by Larson describes a hold-back system for an archery bow having an overdraw structure that includes a spring-biased arm. The arm may be positioned to intercept the bowstring when partially drawn and hold it in that position. When the bowstring is further drawn to fire the arrow, the arm automatically retracts away from the bowstring. The hold-back device is adjustably attachable to an existing cable guard or to a separate mounting rod.

In U.S. Pat. No. 5,156,138, Grover discloses an apparatus for drawing a bow including a hand graspable, bowstring gripping member for detachably gripping and rearwardly drawing the bowstring to flex the bow to a drawn condition and for releasing the bowstring to propel an arrow. An elongated draw bar is mounted on the hand graspable member, and a guide member is mounted on the bow for slidably receiving and guiding the draw bar for movement in a to-and-for reciprocal path of travel relative to the bow between an inoperative position and a rearward bowstring drawing position. A lock member detachably holds the draw bar in the rearward bowstring drawing position and includes a stop member movable between a holding position forward of and in the path of the forward end of the draw bar when the draw bar is in the drawn position, and a draw bar releasing position, which is removed from the path of travel.

Perkins, in U.S. Pat. No. 5,390,654, describes a bowstring stabilizer bar, telescopically carried by a bracket attached to a bow. The bar carries, at its end remote from the bow, a bowstring clamp and handle assembly and a flexible element, whose length is adjustable. The flexible element limits the extent to suit an individual archer to which the bar can be telescopically extended and, hence, the extent to which the bowstring can be retracted preparatory to shooting an arrow. The stabilizer bar restrains the bow and bowstring to move in a relatively fixed plane each time the string is retracted for shooting an arrow, thereby vastly increasing the accuracy of the archer.

In U.S. Pat. No. 5,465,705, Baeseman discloses a precocking assembly for an archery bow that includes an elongated rod, pivotally attached at one end to the riser of a bow. A spring-biased head member is rotatably mounted on the other end of the rod, and a spring-biased bowstring retaining member is attached to the head member. The retaining member is positioned to intercept the bowstring, when the bowstring is partially drawn, and hold it in that position. When the bowstring is further drawn to fire the arrow, the head member rotates to reposition the bowstring retaining member to a retracted position.

Creel, Sr., in U.S. Pat. No. 5,598,830, describes a support for a cocked bow, mounted to the bow handle, and provides a rod for supporting the bowstring in a fully cocked position. The device is spring biased to engage the drawn string. A finger-operated handle, positioned in front of the bow handle, permits smooth controlled movement of the rod away from engagement with the bowstring. The rod pivots about a split bearing mounted along a vertical line, effectively preventing vertical motion or vibration of the rod. The mounting of the device directly couples sheer forces from the drawn bowstring into the handle, providing a strong mount.

In U.S. Pat. No. 5,649,524, Pullin discloses an archery bow tensioning device for holding a bowstring in a fully drawn position. One end of a rod is freely received in and releasable from a blind bore provided in the bow handle, and the opposite end of the rod is provided with a trigger mechanism having a safety catch. The trigger mechanism is T-shaped with a release peg that is operated by the user's thumb.

Goff et al, in U.S. Pat. No. 5,944,004, describe a combination stabilizer/drawlock device for use with an overdraw arrow rest in archery and bow hunting. The stabilizer/drawlock device includes an elongated mounting bracket having near its forward end a bolt slot for attaching the bracket to an archery bow's handle. Intermediate the forward and rearward ends of the bracket is a support for an overdraw arrow rest that permits the arrow rest to be positioned at a selectable distance to the rear of the bow's handle. The device further includes a draw tube attached to the rearward end of the mounting bracket and a draw rod in telescoping engagement with the draw tube. The draw tube can be attached to the bow at a selectable angle or permitted to pivot freely to align with the axis of the arrow between the nock point and the arrow rest after vertical adjustment to a tuned nocking point. The back end of the draw rod supports a bowstring mechanical release. A latching device locks and holds the draw rod at a full draw position when the bowstring is drawn beyond the full draw position. The drawlock latch may be removed and replaced by an interchangeable plate, which acts as a stabilizer but which does not include the spring lever, pivot point and stop pin. The stabilizer plate is used to accommodate state hunting and sport regulations, which may not permit the use of a drawlock mechanism. In both plate configurations, the device uses the draw rod as a stabilizer.

In U.S. Pat. No. 6,012,440, Grindle discloses a brace for an archery bow, which safely keeps the bow in a cocked position for an extended period of time without fatigue. The brace has a front leg, a middle leg, and a rear leg. In the cocked position, the brace legs are selectively prevented from pivoting longitudinally by first and second pivot stops. The coordination of the relative angles between the front, middle and rear brace legs provides the brace with stability to withstand the tension of shooting an arrow.

Goff et al., in U.S. Pat. No. 6,161,532, describe an archery bow with a drawlock device for use with an overdraw arrow rest. The device includes an elongated mounting bracket, attached at its forward end to the bow's handle, and having intermediate its forward and rearward ends, an overdraw arrow rest. The device further includes a draw tube attached to the rearward end of the mounting bracket and a draw rod in telescoping engagement with the draw tube. In a preferred embodiment, the draw tube can be attached to the mounting bracket at a selectable angle to align with the axis of the arrow between the nock point and arrow rest after vertical adjustment to a tuned nocking point. The back end of the draw rod supports a bowstring mechanical release. A latching device locks the draw rod at a full draw position when the bowstring is drawn beyond the full draw position.

In U.S. Pat. No. 6,196,210, Chamberlain discloses a compound bow with a stabilizing pin affixed to the base of the sight window of the bow at an angle less than 90 degrees with reference to the horizontal lie of the base of the sight window. A porous arrow includes a through hole in proximity to the tip of the arrow. The arrow is placed on the bow rest and engaged and held statically by the stabilizing pin upon near full extension by an archer of the bowstring of the bow.

Groover et al., in U.S. Pat. No. 6,213,113, describe a mechanism for assisting an archer in drawing back a bowstring. The bowstring draw assist mechanism includes two interactive components. The first component, a support frame in the form of cable guards and a cross bar, is affixed to the bow, and the second component, a gauntlet, is worn by an archer. The first and second components engage one another and utilize compressed gas to pressurize a cylinder, assisting an archer in drawing the bowstring.

In U.S. Pat. No. 6,679,240, Hurd discloses an arrow launching apparatus for attachment to a bow handle that includes a launcher-to-bow-handle attachment assembly connected to the bow handle. A launcher assembly is connected to the launcher-to-bow-handle attachment assembly. The launcher assembly includes a guide member assembly and a carriage block supported on the guide member assembly, and the carriage block rides along the guide member assembly. The carriage block includes a bow-string-reception channel for receiving a bowstring. The carriage block hold and release assembly is supported on the guide member assembly and provides for selectively preventing or permitting travel of the carriage block along the guide member assembly. Use of the apparatus permits a user to use both hands when aiming and shooting an arrow. The apparatus also permits use of shorter-than-conventional-length arrows.

Kees, in U.S. Pat. No. 6,968,836, describes a drawlock device employed with a bow, such as a compound bow, that provides for drawing and locking the bowstring at the let-off point, then drawing the bowstring a short distance at which point the lock disengages the bowstring, simultaneously firing the arrow nocked on the bowstring.

In U.S. Pat. No. 7,299,795, Brannen discloses a device for transferring the drawn weight of a bowstring from a user's bowstring gripping hand to a user's bow gripping hand. The device includes a shaft and a means for releasably connecting the bowstring to the device, such as a trigger release. The device also includes a transfer grip, which has a gripping portion configured to be grasped by the user's bow gripping hand together with the bow grip when the user draws the device and bowstring to the drawn position. In the preferred embodiment, a handle is used on one end of the shaft, and the trigger release is attached to the handle so that the user can use their bowstring gripping hand to draw the device together with the bowstring to the drawn position and then actuate the release of the bowstring using the trigger of the trigger release. A receiver is also provided for receiving the shaft of the device when the device is drawn from the undrawn position to the drawn position.

None of these patents provide a drawlock system in which the draw bar and bowstring holder are locked only by the hands of the archer. Consequently, applicants have invented a drawlock device in which the bowstring is released by the archer when firing an arrow. The drawlock device of the present invention functions in alignment with the arrow's path. In addition, the drawlock device is adjustable to fit users with different size hands.

Applicants have devised a draw bar and draw holding device that utilizes the principal of levers such that the archer can hold the draw, employing only a fraction of the effort normally required.

SUMMARY OF THE INVENTION

The invention is directed to a draw holding and draw releasing mechanism assembly, adapted for attachment to an archery bow. The mechanism assembly comprises a mounting bracket member, adapted for attachment to the handle of a bow adjacent the arrow shelf thereof. The mounting bracket member includes a passageway there through, with a levered cam member mounted therein for selectively varying the size of the passageway. A linear, draw bar member has a first end that is reversibly movable within the passageway in the mounting bracket member. The draw bar member is selectively locked within the passageway by actuation of the levered cam member mounted therein. The linear, draw bar member includes a hand grip member at a second end thereof and a linear slot adjacent thereto. A cam member is rotatably mounted to the draw bar member, adjacent the linear slot therein. The cam member includes a cradle notch therein at a first end thereof and a finger grip member at a second end thereof. The cam member is rotatable from a bowstring accepting position, with the cradle notch open to the slot in the draw bar member, to a bowstring retaining position, with the cradle notch intersecting the slot in the draw bar member. The user moves the draw bar member within the passageway of the mounting bracket member so the draw bar member accepts the bowstring into the linear slot therein and into the cradle notch of the cam member. The user then grasps the finger grip member to rotate the cam member to intersect the cradle notch with the linear slot and retain the bowstring therein. The user moves the bowstring to the desired draw and then actuates the levered cam member to temporarily lock the draw bar member to the mounting bracket member. Releasing the finger grip member by the user allows the cam member to rotate and release the retained bowstring.

In a preferred embodiment of the invention, the mounting bracket member includes an inverted U-shaped section, with the levered cam member pivotally mounted therein, providing a passageway of variables size there through. Most preferably, the second end of the linear, draw bar member is offset such that the linear slot therein aligns with the bowstring upon insertion of the first end of the linear, draw bar member into the passageway of the mounting bracket member.

In a further embodiment of the invention, the draw bar member includes a plurality of mounting apertures adjacent the linear slot for varying the location of the cam member relative to the hand grip member.

DESCRIPTION OF THE EMBODIMENTS

Nomenclature

Figure 1:
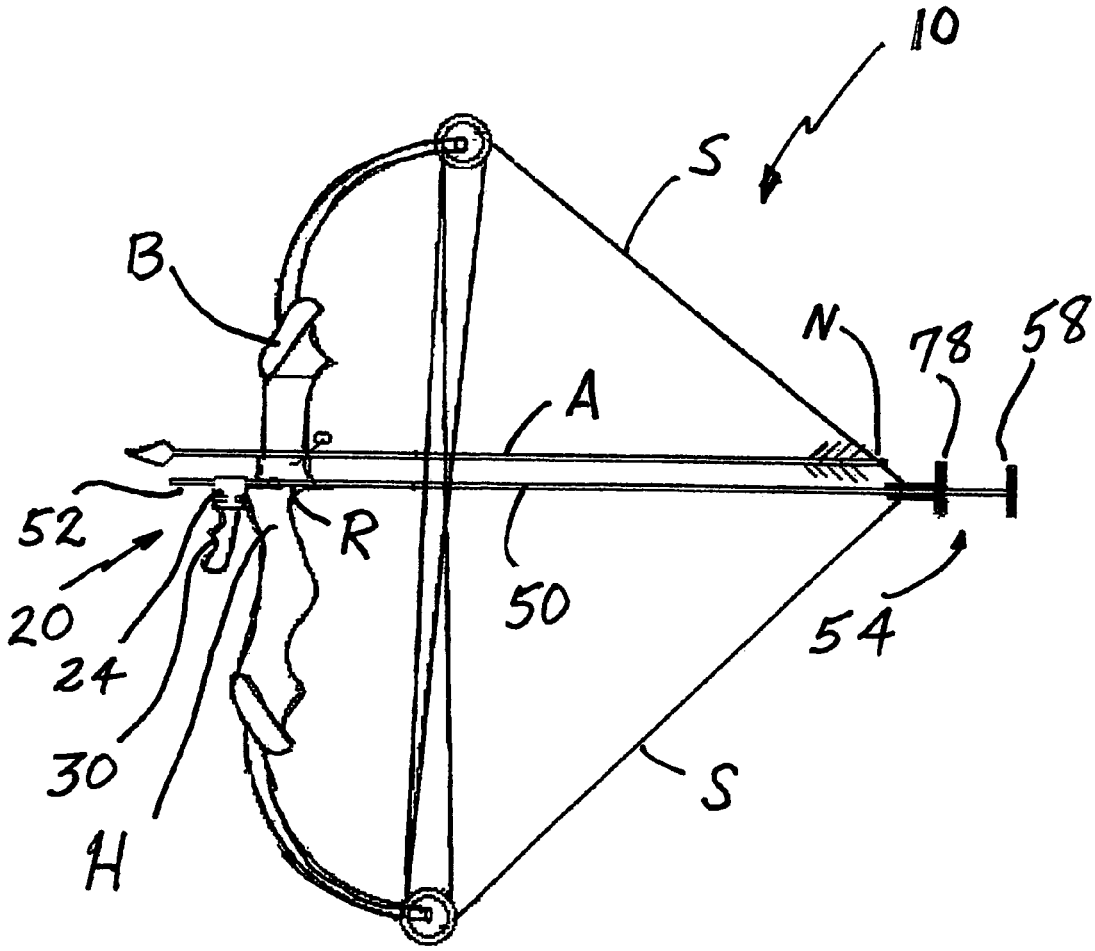
FIG. 1 is a side perspective view of a compound bow, employing the draw holding and draw releasing mechanism assembly of the present invention.

10 Draw Holding and Draw Releasing Mechanism Assembly
20 Mounting Bracket Member
22 Passageway of Mounting Bracket Member
24 U-Shape Section of Mounting Bracket Member
26 Apertures for Mounting Levered Cam Member
28 Bow Handle Engaging Base Section of Bracket Member
29 Mounting Plate Section of Bracket Member
30 Levered Cam Member
32 Cam End of Cam Member
34 Lever End of Cam Member
36 Mounting Pin of Cam Member
38 Aperture for Mounting Pin of Cam Member
50 Linear Draw Bar Member
52 First End of Draw Bar Member
54 Second End of Draw Bar Member
56 Linear Slot of Draw Bar Member
58 Hand Grip Member of Draw Bar Member
60 Cam Member Mounting Apertures of Draw Bar Member
62 Flat Sides of Draw Bar Member
64 Edges of Draw Bar Member
70 Cam Member
72 First End of Cam Member
74 Second End of Cam Member
76 Cradle Notch of Cam Member
78 Finger Grip Member of Cam Member
80 Mounting Pin for Cam Member
82 Flat Sides of Cam Member
84 Edges of Cam Member
A Arrow Shaft
B Archery Bow
H Handle Section of Bow
N Nock of Arrow
R Arrow shelf Section of Bow
S Bowstring

Construction

The invention outlined in the disclosure is a draw holding and draw releasing mechanism assembly, adapted for attachment to an archery bow. The mechanism assembly comprises a mounting bracket member, adapted for attachment to the handle of a bow adjacent the arrow shelf thereof. The mounting bracket member includes a passageway there through, with a levered cam member mounted therein for selectively varying the size of the passageway. A linear, draw bar member has a first end that is reversibly movable within the passageway in the mounting bracket member. The draw bar member is selectively locked within the passageway by actuation of the levered cam member mounted therein. The linear, draw bar member includes a hand grip member at a second end thereof and a linear slot adjacent thereto. A cam member is rotatably mounted to the draw bar member adjacent the linear slot therein. The cam member includes a cradle notch therein at a first end thereof and a finger grip member at a second end thereof. The cam member is rotatable from a bowstring accepting position, with the cradle notch open to the slot in the draw bar member, to a bowstring retaining position, with the cradle notch intersecting the slot in the draw bar member. The user moves the draw bar member within the passageway of the mounting bracket member so the draw bar member accepts the bowstring into the linear slot therein and into the cradle notch of the cam member. The user then grasps the finger grip member to rotate the cam member to intersect the cradle notch with the linear slot and retain the bowstring therein. The user moves the bowstring to the desired draw and then actuates the levered cam member to temporarily lock the draw bar member to the mounting bracket member. Releasing the finger grip member by the user allows the cam member to rotate and release the retained bowstring.

In a preferred embodiment of the invention, the mounting bracket member includes an inverted U-shaped section with the levered cam member pivotally mounted therein, providing a passageway of variables size there through. Most preferably, the second end of the linear, draw bar member is offset such that the linear slot therein aligns with the bowstring upon insertion of the first end of the linear, draw bar member into the passageway of the mounting bracket member.

In a further embodiment of the invention, the draw bar member includes a plurality of mounting apertures adjacent the linear slot for varying the location of the cam member relative to the hand grip member.

Figure 2:
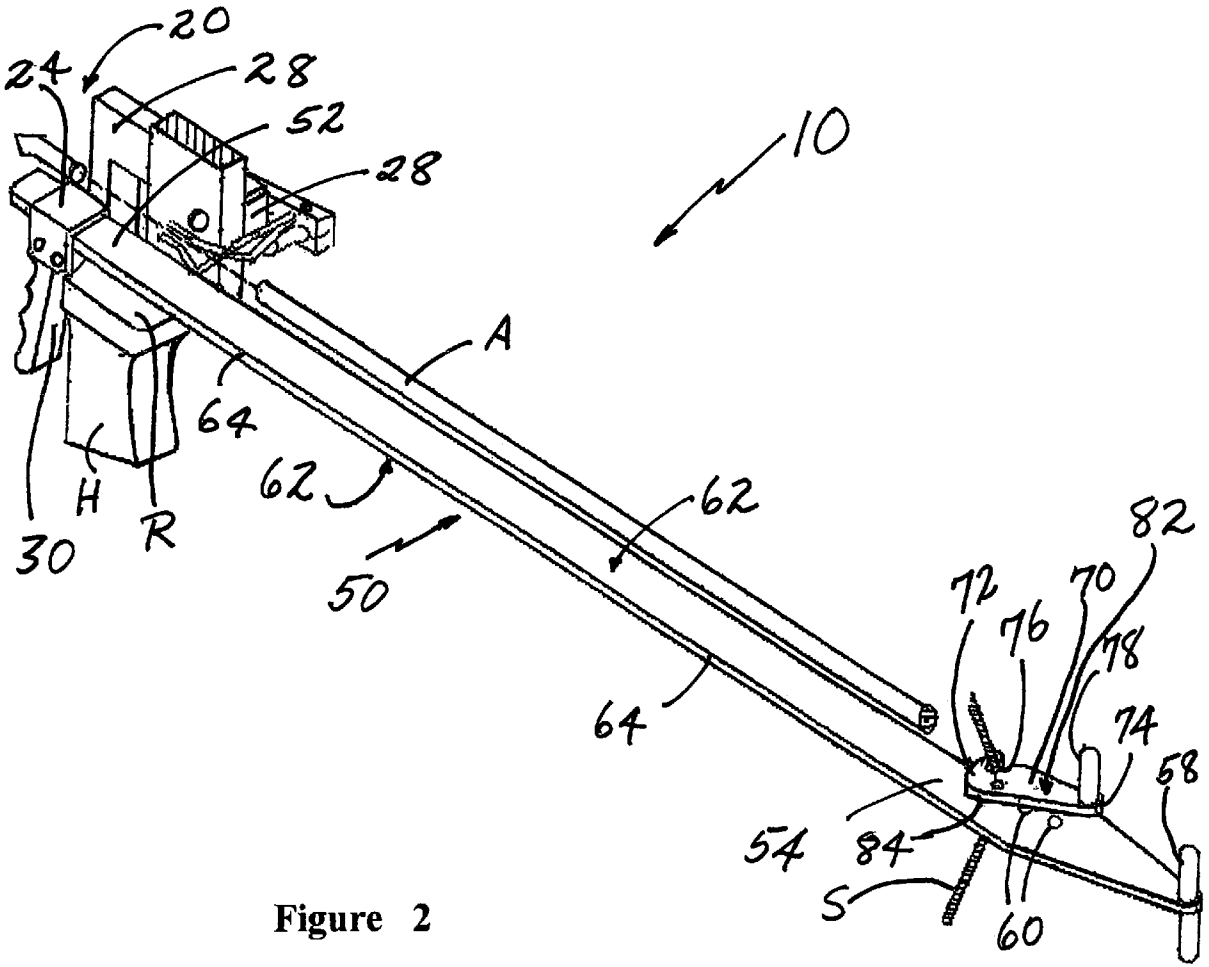
FIG. 2 is another perspective view of a compound bow, employing the draw holding and draw releasing mechanism assembly of the present invention.

Referring now to FIGS. 1 and 2, a first embodiment of the draw holding and draw releasing mechanism assembly 10 is illustrated. The assembly 10 is adapted for attachment to an archery bow B. The mechanism assembly 10 comprises a mounting bracket member 20, adapted for attachment to the handle section H of a bow B adjacent the arrow shelf section R thereof. The archery bow B, illustrated in FIG. 1 is a compound bow, although the mechanism assembly 10 can be used with recurve bows or long bows with comparable results. The mounting bracket member 20 includes a passageway 22 there through, with a levered cam member 30 mounted within the passageway 22 for selectively varying the size of the passageway 22.

Figures 3A, 3B:
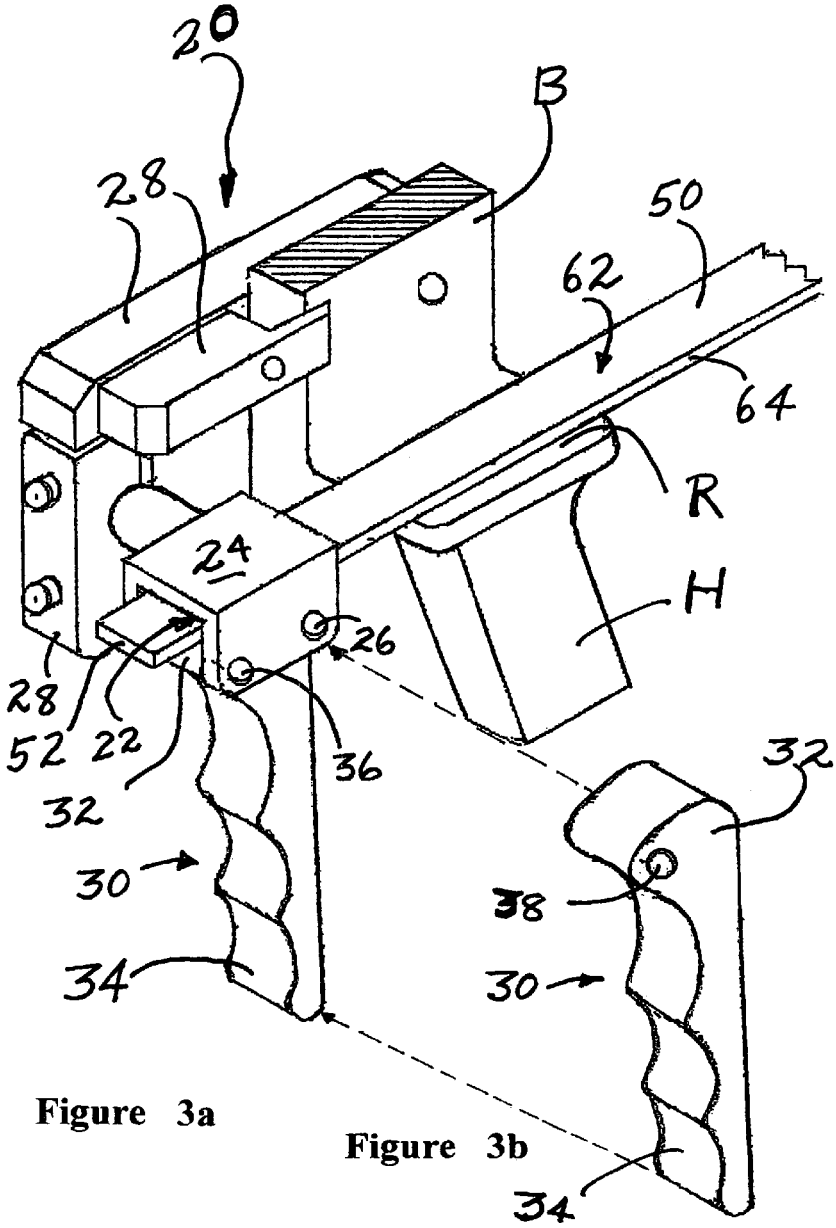
FIG. 3*a* is a perspective view of a preferred embodiment of the draw holding and draw releasing mechanism assembly of the present invention, secured to a right-handed bow.
FIG. 3*b* is a perspective view of the levered cam member of the draw holding and draw releasing mechanism assembly of the present invention, secured to a right-handed bow.
Figures 4A, 4B:
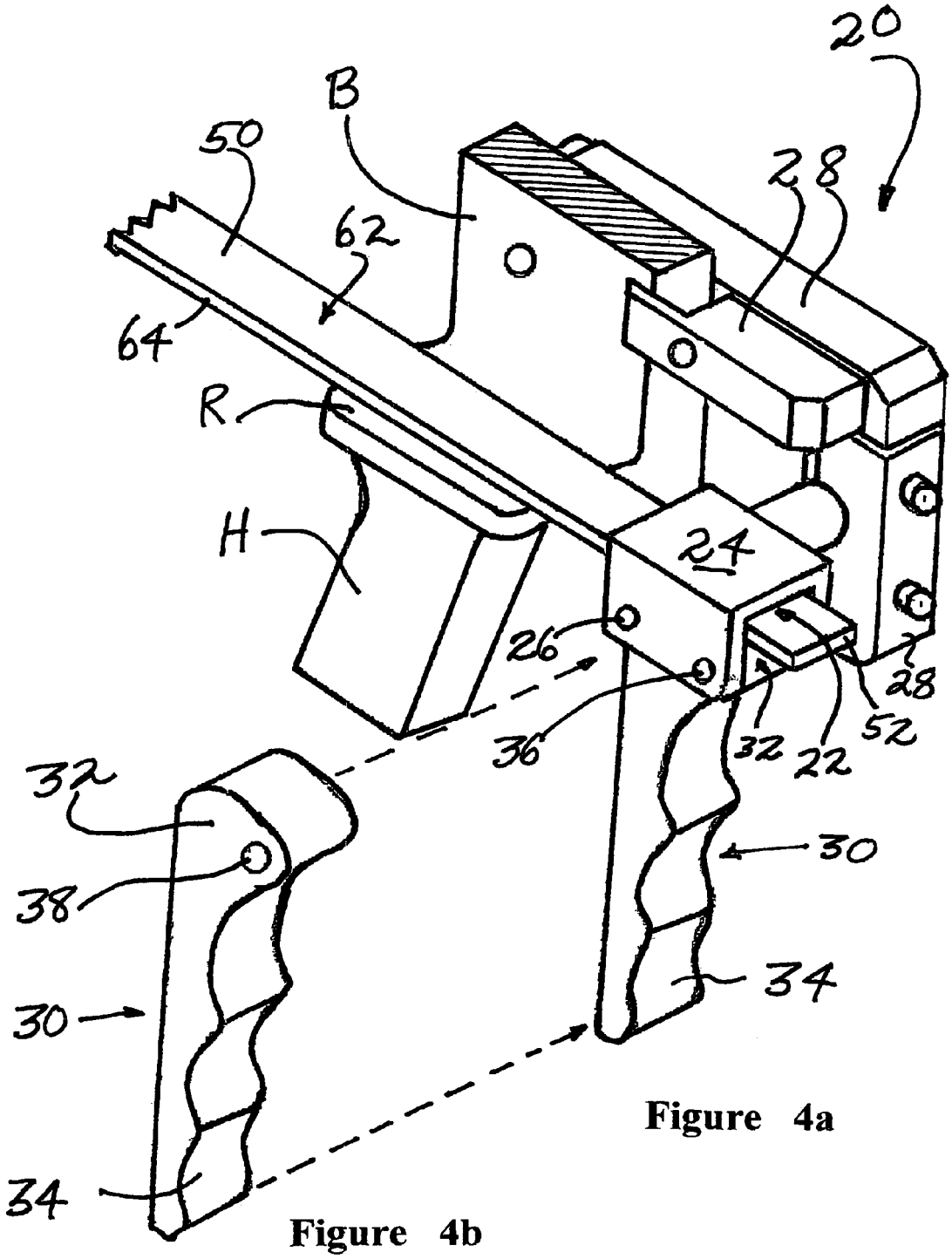
FIG. 4*a* is a perspective view of a preferred embodiment of the draw holding and draw releasing mechanism assembly of the present invention, secured to a left-handed bow.
FIG. 4*b* is a perspective view of the levered cam member of the draw holding and draw releasing mechanism assembly of the present invention, secured to a left-handed bow.

Preferably, the mounting bracket member 20 includes an inverted U-shaped section 24, with the levered cam member 30 pivotally mounted therein, providing variation in the size of the passageway 22 there through. In the embodiment of FIGS. 2-4, the mounting bracket member 20 includes a base section 28, secured to the bow handle H, for supporting the inverted U-shaped section 24, such that the passageway 22 is aligned with the arrow shelf section R of the handle section H, and the lever end 34 of the levered cam member 30 is positioned adjacent the handle section H of the bow B, as illustrated. The U-shaped section 24 and the levered cam member 30 are shown in greater detail in FIGS. 3*a*, 3*b*, 4*a* and 4*b*, which illustrate attachment of the mounting bracket member 20 to either a right-handed bow B or a left-handed bow B. The levered cam member 30 includes a cam end 32 and a lever end 34, with an aperture 38 in the cam end 32 for pivotally securing the cam end 32 within the U-shaped section 24 with a mounting pin 36. The cam end aperture 38 is offset from the vertical axis of the lever cam member 30, so that movement of the lever end 34 pivots the cam end 32 further into the U-shaped section 24 to decrease the size of the passageway 22 there through.

The base section 28 of the mounting bracket member 20 is universal, in that the base section 28 can be configured for attachment to either a right-handed or left-handed bow B, as shown in FIGS. 3*a*, 3*b* and 4*a*, 4*b*, respectively. Similarly, the U-shaped section 24 of the mounting bracket member 20, is universal, in that the U-shaped section 24 can be configured for attachment to the base section 28 mounted to either a right-handed or left-handed bow B. The U-shaped section 24 includes two apertures 26, which allows for mounting the levered cam member 30 for either a right-handed or left-handed bow B. Thus, the mounting bracket member 20 is universal.

A linear, draw bar member 50 has a first end 52 that is reversibly movable within the passageway 22 in the mounting bracket member 20. Preferably, the linear, draw bar member 50 has a rectangular cross section, providing opposed, flat sides 62 and opposed edges 64, with one flat side 62 contacting the levered cam member 30 mounted in the passageway 22 of the mounting bracket member 20. The draw bar member 50 is selectively locked within the passageway 22 by actuation of the levered cam member 30 mounted therein. The user merely grasps both the bow handle section H and the lever end 34 of the levered cam member 30 with one hand to provide controlled pivoting of the cam end 32 within the U-shaped section 24 of the mounting bracket member 20 to secure the draw bar member 50 therein. The flat draw bar member 50 also contacts the arrow shelf section R of the bow B, allowing smooth movement of the draw bar member 50 within the passageway 22.

Figure 5:
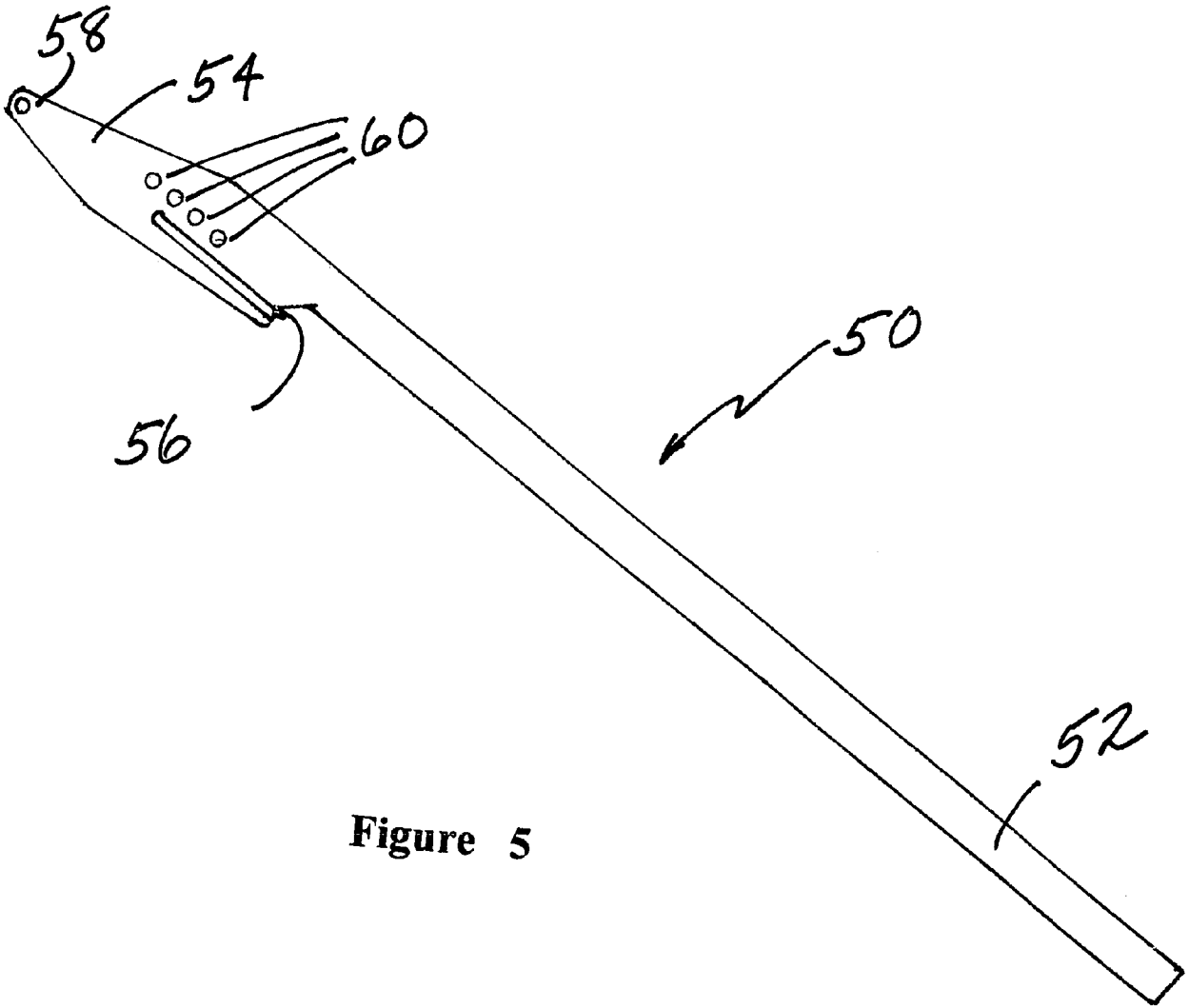
FIG. 5 is a perspective view of the linear, draw bar member of the draw holding and draw releasing mechanism assembly of the present invention.
Figure 6:
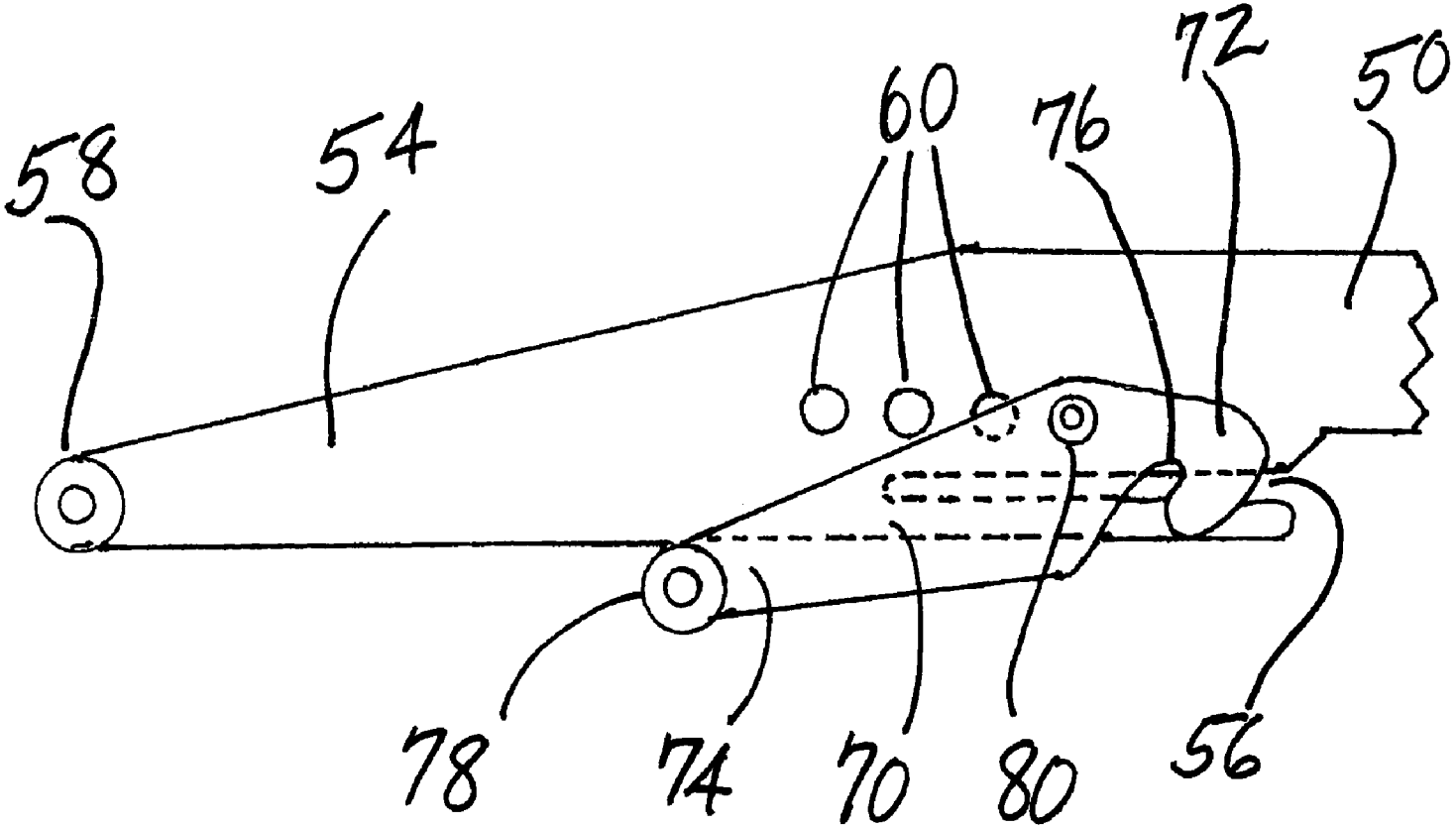
FIG. 6 is a top view of the linear, draw bar member and cam member of the draw holding and draw releasing mechanism assembly of the present invention.

The linear, draw bar member 50 also includes a hand grip member 58 at a second end 54 thereof and a linear slot 56 adjacent to the hand grip member 58, as illustrated in FIG. 5. A cam member 70 is rotatably mounted to the draw bar member 50 adjacent the linear slot 56 therein, as shown in FIG. 6. A mounting pin 80 pivotally attaches the cam member 70 to the draw bar member 50. The cam member 70 includes a cradle notch 76 therein at a first end 72 thereof and a finger grip member 78 at a second end 74 thereof. Preferably, the cam member 70 has a rectangular cross section providing opposed flat sides 82 and opposed edges 84, with one flat side 82 of the cam member 60 mounted in contact with one flat side 62 of the draw bar member 50. Most preferably, the second end 54 of the linear, draw bar member 50 is offset such that the linear slot 56 therein, adjacent the second end 54 thereof, aligns with the bowstring S upon insertion of the first end 52 of the linear, draw bar member 50 into the passageway 22 of the mounting bracket member 20, as illustrated in FIG. 2.

Figure 7:
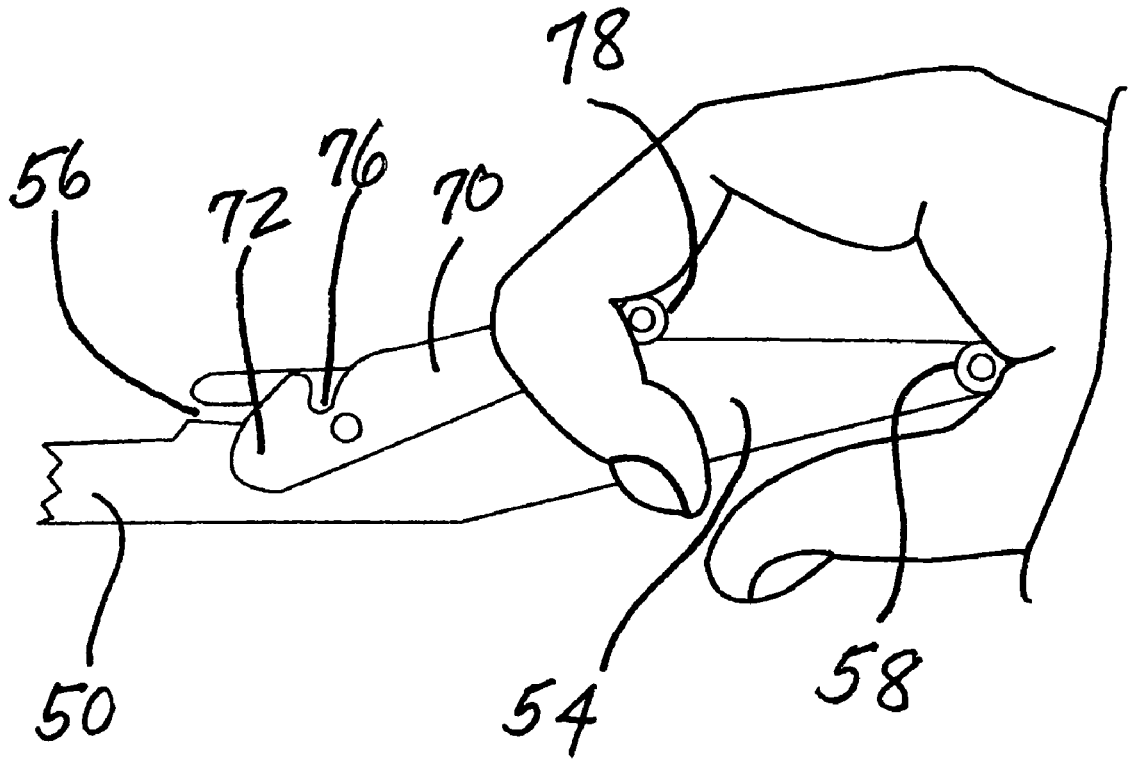
FIG. 7 is a top view of the linear, draw bar member and cam member in the bowstring captured position of the draw holding and draw releasing mechanism assembly of the present invention.

In a preferred embodiment of the invention, the hand grip member 58 comprises a rod extending in opposed directions from the draw bar member 50, and the finger grip member 78 comprises a rod extending in opposite directions from the cam member 70, as illustrated in FIGS. 1 and 2. The preferred embodiment of the hand grip member 58 and the finger grip member 78 provide facile grasping of these two members 58, 78 by the user with one hand, as illustrated in FIG. 7.

In a further embodiment of the invention, a plurality of mounting apertures 60, best seen in FIG. 5, are provided in the draw bar member 50 adjacent the linear slot 56, for varying the location of pivotal attachment of the cam member 70 relative to the hand grip member 58. Thus, the distance between the hand grip member 58 and the finger grip member 78 can be varied and tailored to the hand size of a particular user.

Figures 8A, 8B, 8C:
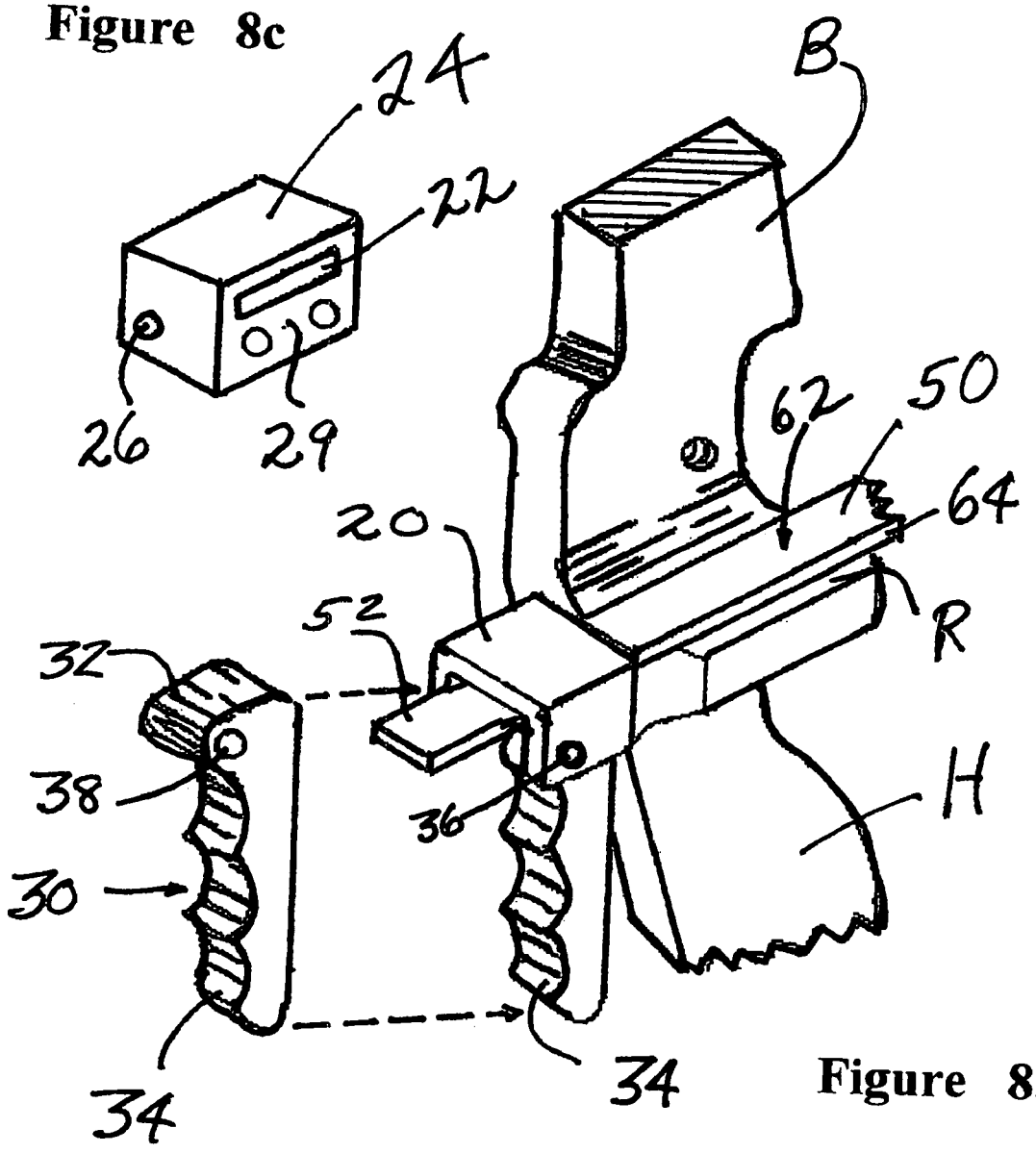
FIG. 8*a* is a perspective view of an alternative embodiment of the mounting bracket member of the draw holding and draw releasing mechanism assembly of the present invention, secured to a bow handle.
FIG. 8*b* is a perspective view of the levered cam member of the draw holding and draw releasing mechanism assembly of the present invention, secured to a right-handed bow.
FIG. 8*c* is a perspective rear view of the mounting bracket member of FIG. 8*a* of the draw holding and draw releasing mechanism assembly of the present invention.

Referring now to FIGS. 8*a*-8*c*, an alternative embodiment of the mounting bracket member 20 is illustrated. In this embodiment, the mounting bracket member 20 comprises the U-shaped section 24 with an apertured, mounting plate section 29, attached across one edge thereof. The passageway 22 within the mounting bracket member 20 is best seen in FIG. 8*c*. The mounting bracket member 20 is attached to the bow handle section H just below the arrow shelf R by threaded fasteners (not shown), such as screws or bolts, passing through the apertured, mounting plate section 29 and into the handle section H. The levered cam member 30 is mounted within the U-shaped section 24 by a mounting pin 36. The mounting bracket member 20 receives the first end 52 of the draw bar member 50 through the passageway 22 within the U-shaped section 24, and the levered cam member 30 selectively secures the draw bar member 50 within the U-shaped section 24, as described above.

Figure 9A:
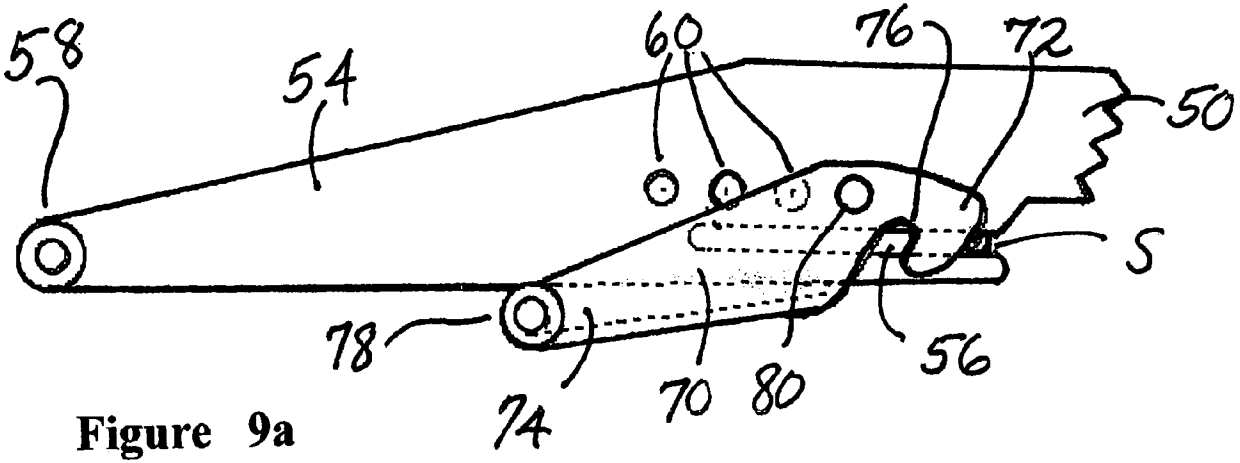
FIGS. 9*a*-9*d* are top views of the linear, draw bar member and cam member, engaging and disengaging the bowstring during use of the draw holding and draw releasing mechanism assembly of the present invention.
Figure 9B:
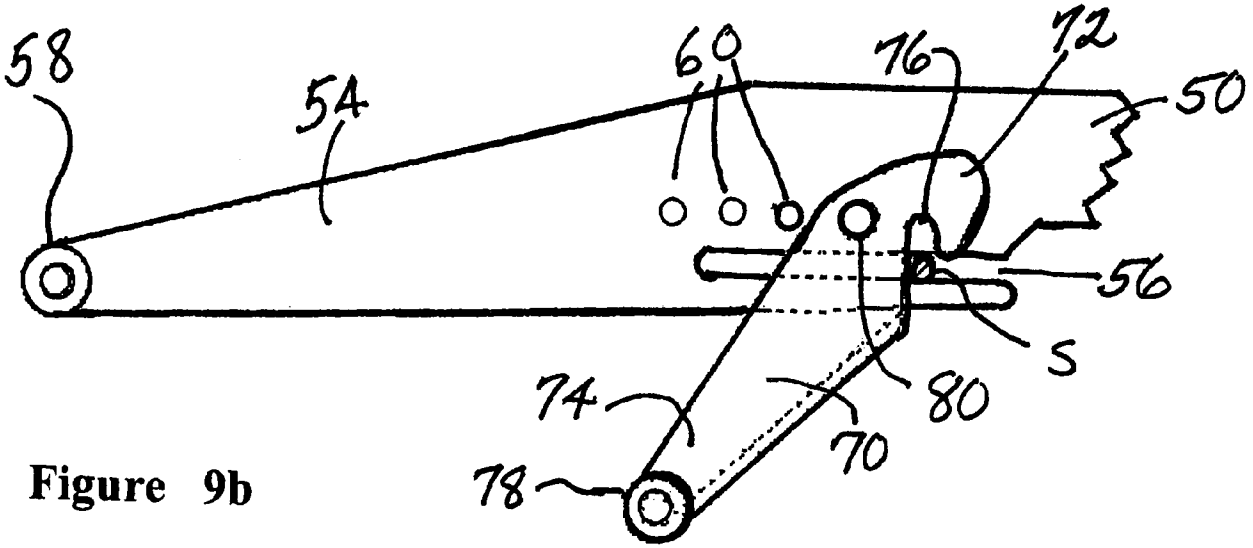
Figure 9C:
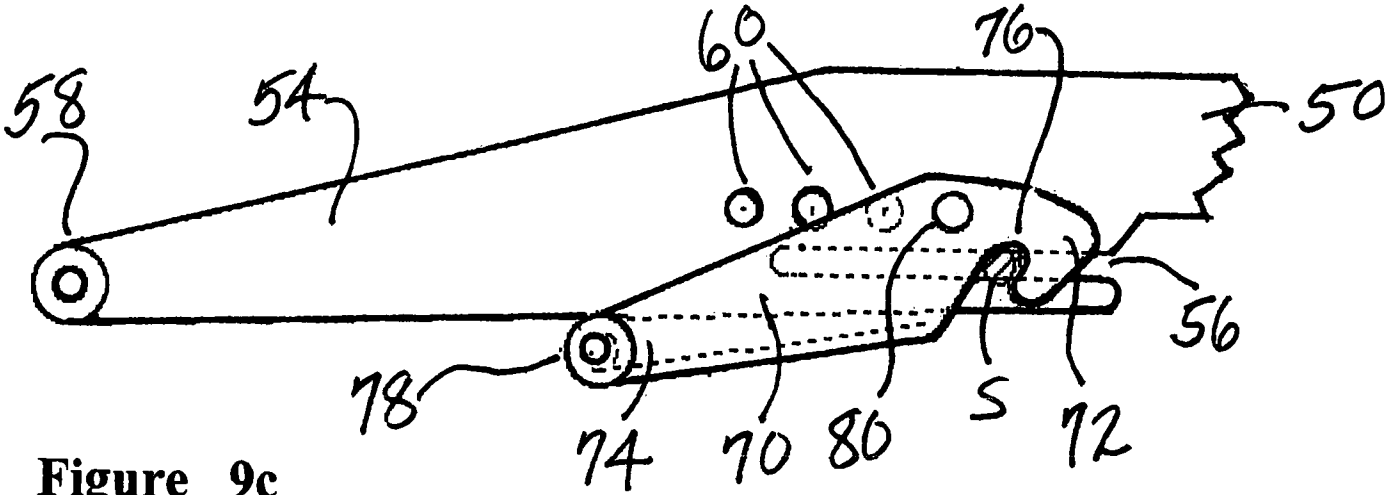

Referring now to FIGS. 9*a*-9*d*, the cam member 70 is rotatable from a bowstring S accepting position, with the cradle notch 76 open to the linear slot 56 in the draw bar member 50 (FIG. 9*b*), to a bowstring S retaining position, with the cradle notch 76 intersecting the linear slot 56 in the draw bar member 50 (FIG. 9*c*). The user moves the draw bar member 50 within the passageway 22 of the mounting bracket member 20 so the draw bar member 20 accepts the bowstring S into the linear slot 56 therein and into the cradle notch 76 of the cam member 70. The user then grasps the finger grip member 78 and hand grip member 58 to rotate the cam member 70 to intersect the cradle notch 76 with the linear slot 56 and retain the bowstring S therein. The user moves the bowstring S to the desired draw and then actuates the levered cam member 30 to temporarily lock the draw bar member 50 to the mounting bracket member 20. The user can thus retain the bowstring S at a full draw condition for an extended time, without the full force of the bowstring S on the hand and arm holding the finger grip member 78. Releasing the finger grip member 78 by the user allows the cam member 70 to rotate and release the retained bowstring S, thus firing the arrow A. The user can then release the levered cam member 30 and move the draw bar member 50 toward the bowstring S to prepare for another draw and fire sequence.

Figure 9D:
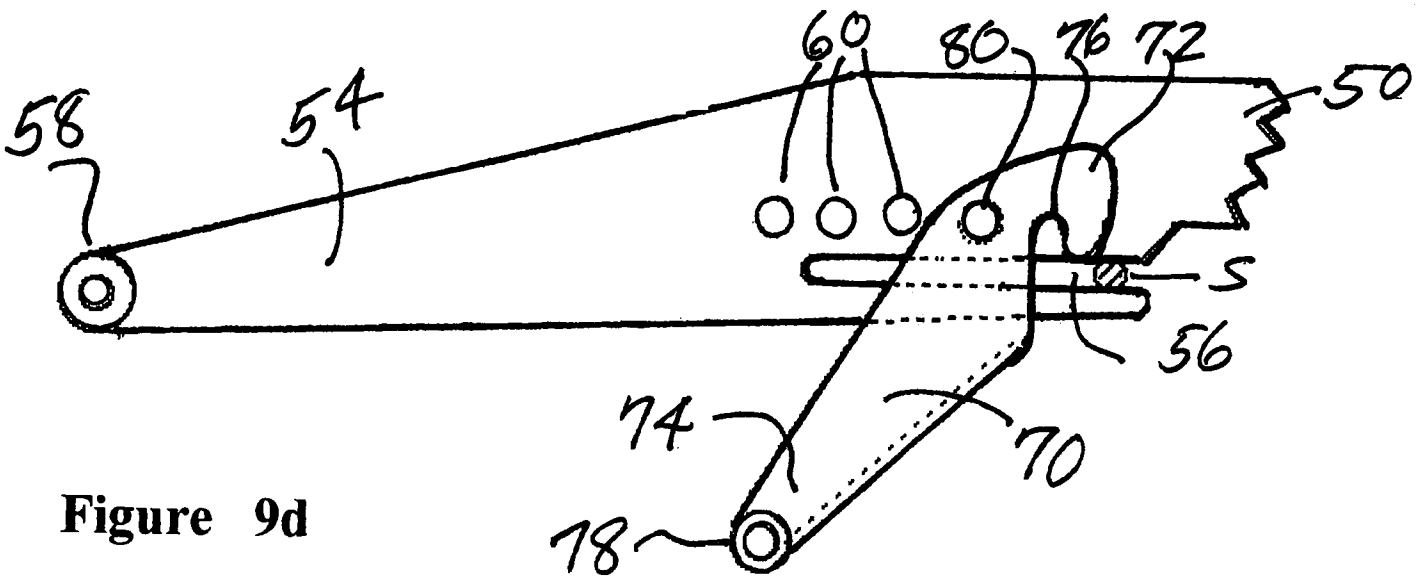

The full sequence of engaging the bowstring S and firing an arrow A employing the draw holding and draw releasing mechanism assembly 10 is a follows. The user releases the levered cam member 30 and moves the draw bar member 50 toward the bowstring S until the bowstring S contacts the first end 72 of the cam member 70, as illustrated in FIG. 9*a*. The bowstring S contacts the first end 72 of the cam member 70, which causes the cam member 70 to rotate and open the cradle notch 76 to the linear slot 56 of the draw bar member 50 with the bowstring S at the open end of the cradle notch 76, as illustrated in FIG. 9*b*. The user may then engage the arrow A with the bowstring S and arrow shelf R. The user then grasps the finger grip member 78 to rotate the cam member 70 to intersect the cradle notch 76 with the linear slot 56 and retain the bowstring S therein, as illustrated in FIG. 9*c*. The user moves the bowstring S to the desired draw, using the finger grip member 78 and hand grip member 58, and then actuates the levered cam member 30 to temporarily lock the draw bar member 50 to the mounting bracket member 20. At this point, the bowstring $ can be held at full draw with little strain on the arm and hand of the user. Releasing the finger grip member 78 by the user allows the cam member 70 to rotate and release the retained bowstring S, as illustrated in FIG. 9*d*, thus firing the arrow A.

Rather surprisingly, the inventors have observed a stabilizing effect upon firing an arrow A from an archery bow B fitted with the draw holding and draw releasing mechanism assembly 10 of the present invention. The assembly 10 is believed to add weight and absorb vibration, thereby providing increased accuracy when firing an arrow A from a bow B fitted with the assembly 10.

While the invention has been particularly shown and described with reference to preferred embodiments thereof, it will be understood by those skilled in the art that various changes in form and details may be made therein without departing from the spirit and scope of the invention.

We claim:

1. A draw holding and draw releasing mechanism assembly adapted for attachment to an archery bow, the mechanism assembly comprising:

a mounting bracket member adapted for attachment to the handle of a bow adjacent the arrow shelf thereof, the mounting bracket member including a passageway there through, with a levered cam member mounted therein for selectively varying the size of the passageway;

a linear, draw bar member having a first end reversibly movable within the passageway in the mounting bracket member, the draw bar member selectively locked within the passageway by actuation of the levered cam member mounted therein;

the linear, draw bar member having a hand grip member secured at a second end thereof and a linear slot adjacent thereto; and a cam member rotatably mounted to the draw bar member adjacent the linear slot therein, the cam member including a cradle notch therein at a first end thereof and a finger grip member at a second end thereof, the cam member rotatable from a bowstring accepting position with the cradle notch open to the slot in the draw bar member, to a bowstring retaining position with the cradle notch intersecting the slot in the draw bar member;

whereby a user moves the draw bar member within the passageway of the mounting bracket member so the draw bar member accepts the bowstring into the linear slot therein and into the cradle notch of the cam member;

the user grasps the hand grip member and the finger grip member to rotate the cam member to intersect the cradle notch with the linear slot and retain the bowstring therein;

the user moves the bowstring to the desired draw and then actuates the levered cam member to temporarily lock the draw bar member to the mounting bracket member; and the user releases the finger grip member allowing the cam member to rotate and release the retained bowstring.

2. The draw holding and draw releasing mechanism assembly adapted for attachment to an archery bow of claim 1, wherein the mounting bracket member includes an inverted U-shaped section with the levered cam member pivotally mounted therein, providing a variables size passageway there through.

3. The draw holding and draw releasing mechanism assembly adapted for attachment to an archery bow of claim 2, wherein the inverted U-shaped section is adapted for direct attachment to the handle of the bow adjacent the arrow shelf and opposite the bowstring.

4. The draw holding and draw releasing mechanism assembly adapted for attachment to an archery bow of claim 2, wherein the inverted U-shaped section is fastened to a bow handle engaging base section adapted for attachment to the handle of the bow adjacent the arrow shelf thereof.

5. The draw holding and draw releasing mechanism assembly adapted for attachment to an archery bow of claim 4, wherein the bow handle engaging base section is adapted for attachment to the handle of either a right-handed or a left-handed bow adjacent the arrow shelf thereof.

6. The draw holding and draw releasing mechanism assembly adapted for attachment to an archery bow of claim 2, wherein the levered cam member includes a cam end and a lever end with the cam end pivotally mounted within the inverted U-shaped section of the mounting bracket member and the lever end positioned adjacent the handle of the bow adjacent the arrow shelf and opposite the bowstring.

7. The draw holding and draw releasing mechanism assembly adapted for attachment to an archery bow of claim 1, wherein the linear, draw bar member includes a rectangular cross section providing opposed flat sides and opposed edges with one flat side contacting the levered cam member mounted in the passageway of the mounting bracket member.

8. The draw holding and draw releasing mechanism assembly adapted for attachment to an archery bow of claim 7, wherein the second end of the linear, draw bar member is offset such that the linear slot therein aligns with the bowstring upon insertion of the first end of the linear, draw bar member into the passageway of the mounting bracket member.

9. The draw holding and draw releasing mechanism assembly adapted for attachment to an archery bow of claim 7, wherein the cam member mounted to the draw bar member includes a rectangular cross section providing opposed flat sides and opposed edges, one flat side of the cam member mounted in contact with one flat side of the draw bar member.

10. The draw holding and draw releasing mechanism assembly adapted for attachment to an archery bow of claim 1, wherein the hand grip member comprises a rod extending in opposed directions from the draw bar member, and the finger grip member comprises a rod extending in opposite directions from the cam member.

11. The draw holding and draw releasing mechanism assembly adapted for attachment to an archery bow of claim 1, further including a plurality of mounting apertures in the draw bar member adjacent the linear slot for varying the location of the cam member relative to the hand grip member.

12. A draw holding and draw releasing mechanism assembly adapted for attachment to an archery bow, the mechanism assembly comprising:

a mounting bracket member adapted for attachment to the handle of a bow adjacent the arrow shelf thereof, the mounting bracket member including an inverted U-shaped section providing a passageway there through, with a levered cam member mounted within the U-shaped section for selectively varying the size of the passageway;

a linear, draw bar member with a rectangular cross section providing opposed flat sides and opposed edges, the draw bar member having a first end reversibly movable within the passageway in the U-shaped section of the mounting bracket member with one flat side contacting the levered cam member, the draw bar member selectively locked within the passageway by actuation of the levered cam member mounted therein;

the linear, draw bar member having a hand grip member secured at a second end thereof and a linear slot adjacent thereto; and a cam member rotatably mounted to the draw bar member adjacent the linear slot therein, the cam member including a cradle notch therein at a first end thereof and a finger grip member at a second end thereof, the cam member rotatable from a bowstring accepting position with the cradle notch open to the slot in the draw bar member, to a bowstring retaining position with the cradle notch intersecting the slot in the draw bar member;

whereby a user moves the draw bar member within the passageway of the mounting bracket member so the draw bar member accepts the bowstring into the linear slot therein and into the cradle notch of the cam member;

the user grasps the hand grip member and the finger grip member to rotate the cam member to intersect the cradle notch with the linear slot and retain the bowstring therein;

the user moves the bowstring to the desired draw and then actuates the levered cam member to temporarily lock the draw bar member to the mounting bracket member; and the user releases the finger grip member allowing the cam member to rotate and release the retained bowstring.

13. The draw holding and draw releasing mechanism assembly adapted for attachment to an archery bow of claim 12, wherein the inverted U-shaped section is adapted for direct attachment to the handle of the bow adjacent the arrow shelf and opposite the bowstring.

14. The draw holding and draw releasing mechanism assembly adapted for attachment to an archery bow of claim 12, wherein the inverted U-shaped section is fastened to a bow handle engaging base section adapted for attachment to the handle of the bow adjacent the arrow shelf thereof.

15. The draw holding and draw releasing mechanism assembly adapted for attachment to an archery bow of claim 14, wherein the bow handle engaging base section is adapted for attachment to the handle of either a right-handed or a left-handed bow adjacent the arrow shelf thereof.

16. The draw holding and draw releasing mechanism assembly adapted for attachment to an archery bow of claim 14, further including a plurality of mounting apertures in the draw bar member adjacent the linear slot for varying the location of the cam member relative to the hand grip member.

17. The draw holding and draw releasing mechanism assembly adapted for attachment to an archery bow of claim 12, wherein the levered cam member includes a cam end and a lever end with the cam end pivotally mounted within the inverted U-shaped section of the mounting bracket member and the lever end positioned adjacent the handle of the bow adjacent the arrow shelf and opposite the bowstring.

18. The draw holding and draw releasing mechanism assembly adapted for attachment to an archery bow of claim 12, wherein the second end of the linear, draw bar member is offset such that the linear slot therein aligns with the bowstring upon insertion of the first end of the linear, draw bar member into the passageway of the mounting bracket member.

19. The draw holding and draw releasing mechanism assembly adapted for attachment to an archery bow of claim 12, wherein the cam member mounted to the draw bar member includes a rectangular cross section providing opposed flat sides and opposed edges, one flat side of the cam member mounted in contact with one flat side of the draw bar member.

20. The draw holding and draw releasing mechanism assembly adapted for attachment to an archery bow of claim 12, wherein the hand grip member comprises a rod extending in opposed directions from the draw bar member, and the finger grip member comprises a rod extending in opposite directions from the cam member.

21. A draw holding and draw releasing mechanism assembly adapted for attachment to an archery bow, the mechanism assembly comprising:

a mounting bracket member adapted for attachment to the handle of a bow adjacent the arrow shelf thereof, the mounting bracket member including an inverted U-shaped section providing a passageway there through, with a levered cam member mounted within the U-shaped section for selectively varying the size of the passageway;

a linear, draw bar member with a rectangular cross section providing opposed flat sides and opposed edges, the draw bar member having a first end reversibly movable within the passageway in the U-shaped section of the mounting bracket member with one flat side contacting the levered cam member, the draw bar member selectively locked within the passageway by actuation of the levered cam member mounted therein;

the linear, draw bar member having a hand grip member secured at a second end thereof, the hand grip member including a rod extending in opposite directions from the draw bar member, and a linear slot in the draw bar member adjacent thereto, the second end of the draw bar member offset such that the linear slot therein aligns with the bowstring upon insertion of the first end of the linear, draw bar member into the passageway of the mounting bracket member; and a cam member rotatably mounted to the draw bar member adjacent the linear slot therein, the cam member including a rectangular cross section providing opposed flat sides and opposed edges, one flat side of the cam member mounted in contact with one flat side of the draw bar member, the cam member including a cradle notch therein at a first end thereof and a finger grip member at a second end thereof including a rod extending in opposite directions there from, the cam member rotatable from a bowstring accepting position with the cradle notch open to the slot in the draw bar member, to a bowstring retaining position with the cradle notch intersecting the slot in the draw bar member;

whereby a user moves the draw bar member within the passageway of the mounting bracket member so the draw bar member accepts the bowstring into the linear slot therein and into the cradle notch of the cam member;

the user grasps the hand grip member and the finger grip member to rotate the cam member to intersect the cradle notch with the linear slot and retain the bowstring therein;

the user moves the bowstring to the desired draw and then actuates the levered cam member to temporarily lock the draw bar member to the mounting bracket member; and the user releases the finger grip member allowing the cam member to rotate and release the retained bowstring.

* * * * *